United States Patent [19]

Kidd et al.

[11] 3,936,173

[45] Feb. 3, 1976

[54] OPTICAL SYSTEM

[75] Inventors: Wayne L. Kidd, Fairport; George N. Tsilibes; Stephen C. Urciuoli, both of Rochester, all of N.Y.

[73] Assignee: Xerox Corporation, Stamford, Conn.

[22] Filed: Oct. 4, 1974

[21] Appl. No.: 511,976

[52] U.S. Cl. ..... 355/3 R; 355/4; 96/1.2; 96/45

[51] Int. Cl.[2] ..... G03G 15/00

[58] Field of Search ..... 355/3 R, 4, 17; 96/1.2, 96/116, 45

[56] References Cited

UNITED STATES PATENTS

| | | | |
|---|---|---|---|
| 3,120,790 | 2/1964 | Carlson et al. | 96/45 X |
| 3,535,036 | 10/1970 | Starkweather | 355/16 X |
| 3,540,806 | 11/1970 | Starkweather | 355/17 X |
| 3,776,633 | 12/1973 | Frosch et al. | 355/18 X |
| 3,788,737 | 1/1974 | Kidd | 355/3 R |

*Primary Examiner*—Robert P. Greiner
*Attorney, Agent, or Firm*—H. Fleischer; J. J. Ralabate; C. A. Green

[57] ABSTRACT

An optical system in which a screened light pattern and a light image of an original document are projected onto a common region of a light receiving member forming a modulated light image thereon. Collimated light rays are employed in the formation of the screened light pattern.

5 Claims, 3 Drawing Figures

OPTICAL SYSTEM

BACKGROUND OF THE INVENTION

This invention relates generally to an electrophotographic printing machine, and more particularly concerns an optical system for producing half tone images of an original document.

The process of electrophotographic printing comprises exposing a charged photoconductive member to a light image of an original document. The irradiated areas of the photoconductive surface are discharged to record thereon an electrostatic latent image corresponding to the original document. A development system moves a developer mix of carrier granules and toner particles into contact with the latent image recorded in the photoconductive surface. The toner particules are attracted electrostatically to the latent image from the carrier granules forming a powder image on the latent image. Subsequently, the toner powder image is transferred to a sheet of support material. After transfer, the sheet of support material passes through a fusing device which permanently affixes the toner powder image thereto.

Essentially, a multi-color printing machine repeats the foregoing process a plurality of cycles, each cycle being for a discrete color. In this process, the light image is filtered to record an electrostatic latent image on the photoconductive surface corresponding to a single color. The single color electrostatic latent image is developed with toner particles complementary in color to the filtered light image employed in the formation thereof. The toner powder image is then transferred to the sheet of support material. The foregoing process is repeated for successively differently colored light images. In this manner, a plurality of toner powder images are transferred, in superposed registration, to the sheet of support material. The multi-layered toner powder image is then fused to the sheet of support material forming a permanent colored copy of the original document.

However, in conventional electrophotographic printing machines toner gradations are difficult to form. Frequently, screening methods are employed to overcome this defect. Such methods produce the effect of toner gradations by variations in dot size. In the highlight zones, the dots will be small and increase in size through the intermediate shades until they merge together in the shadow region. At the extremes, there will be complete whiteness at the highlight end of the tone scale, and nearly solid black at the shadow end. An example of this is found in U.S. Pat. No. 2,598,732 issued to Walkup in 1952.

Another patent exemplifying screening is U.S. Pat. No. 3,535,036 issued to Starkweather in 1970. As disclosed therein, a light image of an original document is projected onto a charged photoconductive surface recording an electrostatic latent image thereon. Subsequently thereto, a screened light image is superimposed over the latent image recorded in the photoconductive surface.

Other patents relating to the use of screens in electrophotographic printing are: U.S. Pat. No. 3,121,010 issued to Johnson et al. in 1964; U.S. Pat. No. 3,493,381 issued to Maurer in 1970; U.S. Pat. No. 3,776,633 issued to Frosch in 1973; and U.S. Pat. No. 3,809,555 issued to Marley in 1974.

It is a primary object of the present invention to improve the optical system of an electrophotographic printing machine to produce continuous tone copies.

SUMMARY OF THE INVENTION

Briefly stated, and in accordance with the present invention, there is provided an optical system for forming a light image of an original document on a light receiving member.

Pursuant to the features of the present invention, this is achieved by projecting means which forms a light image of the original document on the light receiving member. Illuminating means generate light rays which are transmitted through collimating means. Thereafter, the collimated light rays pass through a screen member interposed between the collimating means and the light receiving member. The collimated, screened light image and the light image of the original document are superimposed over a common region of the light receiving member forming a modulated light image thereon.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF INVENTION

Figure 1:
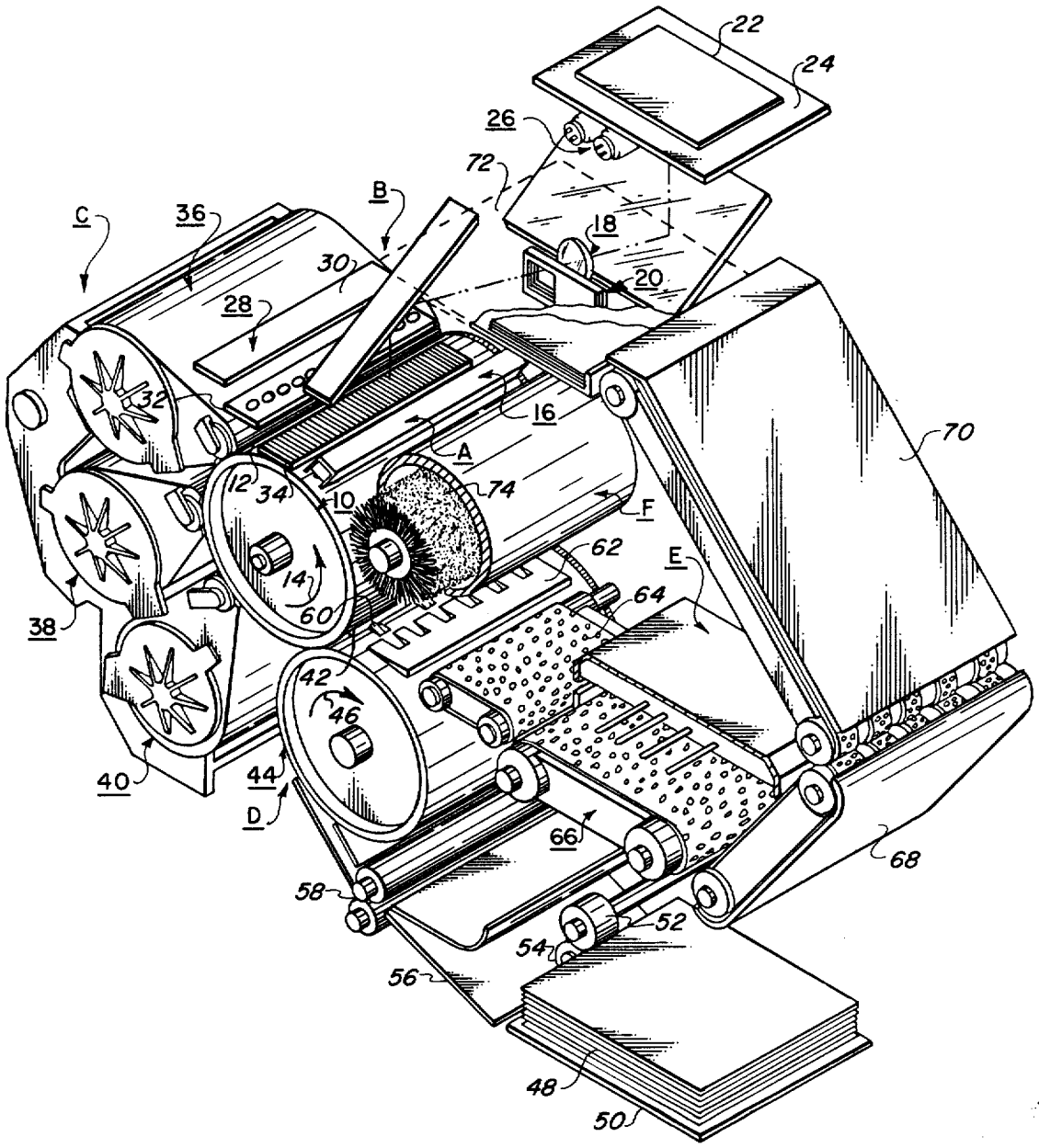
FIG. 1 is a schematic, perspective view of an electrophotographic printing machine incorporating the features of the present invention therein.

For a general understanding of an electrophotographic printing machine, in which the present invention may be incorporated, reference is made to FIG. 1. In the drawings like reference numerals have been used throughout to designate like elements. The electrophotographic printing machine shown in FIG. 1 is arranged to create color copies from a colored original document. The original document may be in the form of single sheets, books or three dimensional objects.

As shown in FIG. 1, the electrophotographic printing machine includes a photoconductive member having a rotatable drum 10 with a photoconductive surface 12 entrained about and secured thereto. Drum 10 is mounted on a shaft (not shown) and rotates in the direction of arrow 14. This moves photoconductive surface 12 sequentially through a series of processing stations. A timing disc is mounted at one end of the shaft or drum 10, thereby activating the appropriate processing stations for producing the desired sequence of events in the printing machine. U.S. Pat. No. 3,655,377 issued to Sechak in 1972 describes a suitable type of material which may be employed for photoconductive surface 12.

For purposes of the present disclosure, the various processing stations disposed about the periphery of drum 10 will be briefly described hereinafter.

As drum 10 rotates in the direction of arrow 14, it passes through charging station A. Charging station A has positioned thereat a corona generating device, indicated generally at 16, which charges photoconductive surface 12 to a relatively high, substantially uniform level. Corona generating device 16 extends in a generally transverse direction across photoconductive surface 12 to produce a spray of ions for the charging thereof. Preferably, corona generating device 16 is of the type described in U.S. Pat. No. 2,778,946 issued to Mayo in 1957.

After photoconductive surface 12 is charged, drum 10 rotates the charged area thereof to exposure station B. At exposure station B, the charged area of photoconductive surface 12 is exposed to a color filtered light image of the original document. A moving lens system, generally designated by the reference numeral 18, and a color filter mechanism, shown generally at 20 are positioned at exposure station B. U.S. Pat. No. 3,062,108 issued to Mayo in 1952 describes a moving lens system suitable for use in electrophotographic printing. Similarly, U.S. Pat. No. 3,775,006 issued to Hartman et al. in 1973 discloses a color filter mechanism suitable for use in the FIG. 1 electrophotographic printing machine. Original document 22 is disposed upon transparent viewing platen 24. Lamp assembly 26 is positioned beneath transparent viewing platen 24, and in conjunction with lens system 18 of filter 20, moves in a timed relationship with drum 10 to scan successive incremental areas of original document 22. In this manner, a flowing light image of original document 22 irradiates the charged area of photoconductive surface 12. During exposure, filter mechanism 20 interposes selected color filters into the optical light path. Successive color filters operate on the light rays passing through lens 18 to create a single color light image which records a single color electrostatic latent image on photoconductive surface 12. The foregoing single color latent image corresponds to a pre-selected spectral region of the electromagnetic wave spectrum.

After the electrostatic latent image is recorded on photoconductive surface 12, a screened light image is projected thereon. A screening apparatus, indicated generally by the reference numeral 28, superimposes a screened light image onto the electrostatic latent image of the original document recorded on photoconductive surface 12. Screening apparatus 28 includes an electroluminescent panel 30 adapted to be energized by a suitable power supply. The light rays projected from panel 30 are transmitted through a collimator or lens strip 32. The collimated or substantially parallel light rays are then transmitted through screen 34. Screen 34 may be a line or dot screen adapted to form a screened light image. The screened light image is projected onto the electrostatic latent image of the original document in superposition therewith. In this manner, a modulated electrostatic latent image is formed on photoconductive surface 12.

After the modulated electrostatic latent image is recorded on photoconductive surface 12, drum 10 rotates to development station C. Three developer units, generally indicated by the reference numerals 36, 38, and 40 are positioned at development station C. A suitable development station employing a plurality of developer units (in this case three) is described in co1-pending application Ser. No. 255,259 filed in 1972. The developer units disclosed therein are magnetic brush developer units. A typical magnetic brush developer unit employes a magnetizable developer mix comprising carrier granules and toner particles. The magnetic brush forms a directional flux field to continually create a brush of developer mix. This brush is brought into contact with the modulated electrostatic latent image recorded on photoconductive surface 12. The toner particles adhering electrostatically to the carrier granules of the developer mix are attracted by the greater electrostatic force to the latent image and render it visible. Developer units 36, 38 and 40, respectively, contain discretely colored toner particles. Each of the toner particles contained in the respective developer units corresponds to the complement of the single color light image transmitted through filter 20. For example, a modulated electrostatic latent image formed from a green filtered light image is rendered visible by depositing green absorbing magneta toner particles thereon. Similarly, electrostatic latent images formed from blue and red light images are developed with yellow and cyan toner particles, respectively.

After the modulated electrostatic latent image recorded on photoconductive surface 12 is developed, drum 10 rotates to transfer station D. At transfer station D, the toner powder image adhering electrostatically to photoconductive surface 12 is transferred to a sheet of final support material 42. A bias transfer roll, shown generally at 44, recirculates sheet 42 and is electrically biased to a potential of sufficient magnitude and polarity to electrostatically attract toner particles from photoconductive surface 12 thereto. A suitable electrically biased transfer roll is described in U.S. Pat. No. 3,612,677 issued to Langdon et al. in 1971. Transfer roll 44, preferably, is of the same diameter as drum 10 and rotates at substantially the same angular velocity therewith. Thus, as transfer roll 44 rotates in synchronism with photoconductive surface 12, successive toner powder images may be transferred to sheet 42. As depicted in FIG. 1, transfer roll 44 rotates in the direction of arrow 46.

Prior to proceeding with a discussion of the remaining processing stations disposed about the periphery of drum 10, the feeding path for support material 42 will be briefly described. As shown in FIG. 1, support material 42 is advanced from a stack 48 thereof disposed on tray 50. Feed roll 52, in operative communication with retard roll 54, separates and advances the uppermost sheet from stack 48. The advancing sheet moves into chute 56 and is directed into the nip of register rolls 58. Register rolls 58 align and forward the advancing sheet, in synchronism with the movement of transfer roll 44 to gripper fingers 60 mounted therein. Gripper finger 60 secure releasably support material 40 to transfer roll 44 for movement in a recirculating path therewith. In this manner, successive toner powder images are attracted electrostatically to support material 42 in superimposed registration with one another forming a multilayered toner powder image thereon. After the successive toner powder images have been transferred to support material 42, gripper finger 60 space support material 42 from transfer roll 44. As transfer roll 44 continues to rotate in the direction of arrow 46, gripper bar 62 is interposed between support material 42 and transfer roll 44. This separates support material 42 from transfer roll 44. Thereafter, endless belt conveyor 64 moves support material 42 to fixing station E.

At fixing station E, a fuser, indicated generally by the reference numeral 66, permanently affixes the transferred toner powder images to support material 42. One type of suitable fuser is exemplified in U.S. Pat. No. 3,498,592 issued to Moser et al. in 1970. After the fixing process, sheet 42 is advanced by endless belt conveyors 68 and 70 to catch tray 72 for subsequent removal from the printing machine by the operator.

Following the transfer process, invariably some residual toner particles adhere to photoconductive surface 12. Cleaning station F, the final processing station in the direction of rotation of drum 10, as indicated by arrow 14, removes the residual toner particles adhering thereto. A pre-clean corona generating device (not shown) neutralizes the charge on photoconductive surface 12 and the residual toner particles. This enables fibrous brush 74 to remove the residual toner particles therefrom. U.S. Pat. No. 3,590,412 issued to Gerbasi in 1971 describes a suitable brush cleaning device.

It is believed that the foregoing description is sufficient for purposes of the present application to describe the features of the electrophotographic printing machine in which the apparatus of the present invention is incorporated.

Figure 2:
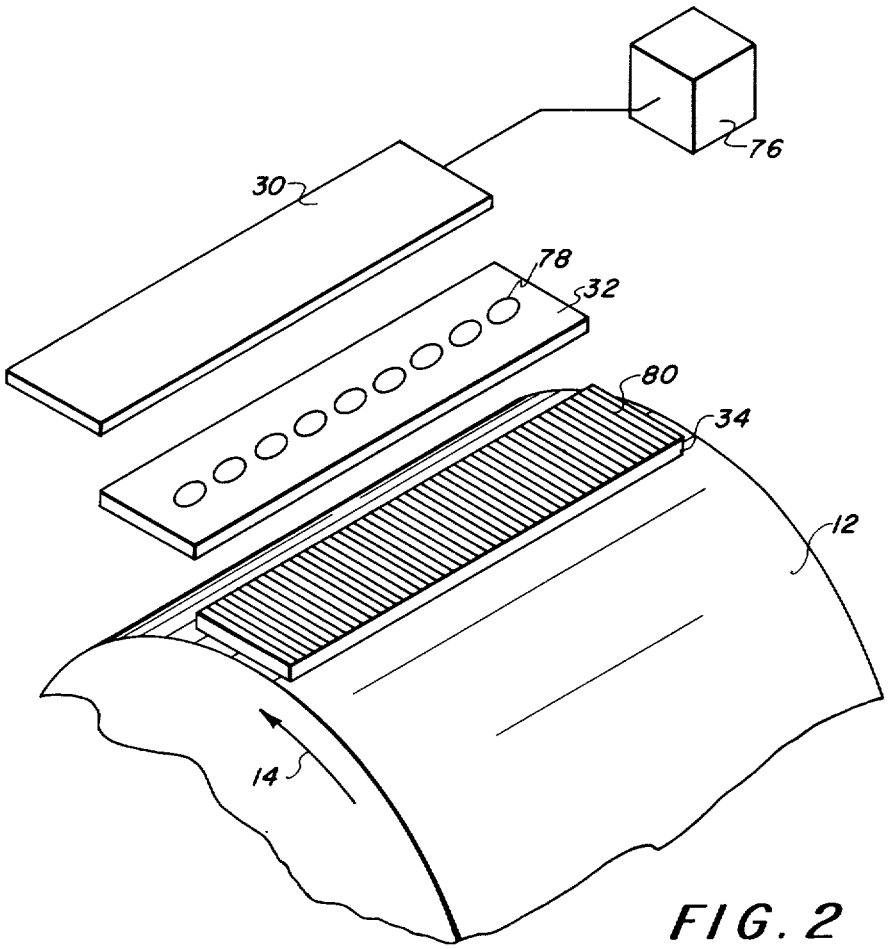
FIG. 2 is an elevational view of the screening system employed in the FIG. 1 printing machine optical system.

Referring now to FIG. 2, screening apparatus 28 is described therein in greater detail. As shown in FIG. 2, power supply 76 excites electroluminescent panel 30. In conventional electroluminescent panels, a layer of luminescent material is interposed between a pair of electrodes and the combination deposited upon a substrate. Generally, the electroluminescent material is made of a phosphor which gives off light when an alternating electrical field is applied to the electrodes. One embodiment of an electroluminescent panel is termed a ceramic electroluminescent panel. This type of panel includes a base metal having a ceramic enamel ground coated layer deposited thereon. A clear ceramic moisture barrier is fixed to the transparent electrode. The moisture barrier is employed to prevent water particles from contaminating the phosphorous layer. In operation, voltage source 76 develops an alternating current which passes from the base plate to the ceramic ground coating, the dielectric, the phosphor, and the transparent electrode. This current excites the phosphor layer resulting in the emission of light therefrom.

An alternate embodiment of electroluminescent panel 30 is made from plastic. This construction is somewhat similar to the ceramic panel. A typical plastic electroluminescent panel has a dielectric layer deposited on an aluminum foil conductor. The dielectric layer may be a layer of barium titanate embedded in plastic. A phosphor layer, which is also embedded in a layer of plastic, is deposited on the dielectric layer. A transparent electrode is secured to the phosphor layer. Preferably, the transparent electrode is a fiber glass paper impregnated with indium to make it conductive. When this fiber glass paper is applied to wet phosphor and an organic binder, it becomes completely transparent. As in the case of the ceramic panel, there is a moisture barrier disposed about the entire panel to prevent moisture particles from contaminating the phosphor. In this case, the moisture barrier is plastic. The electroluminescent panel is also activated by applying an alternating current from power supply 76 across the aluminum conductor through the dielectric phosphor to the transparent conductor. In this manner, the phosphor layer is excited and emits light rays therefrom.

The electroluminescent phosphor is basically a sulphide material. The phosphor is energized to emit light rays when placed in an alternating electric field. In the present invention, power supply 76 may be periodically energized by the voltage circuit depicted in FIG. 3. In this manner, electroluminescent panel 30 may be strobed furnishing pulsed light rays rather than continuous light rays therefrom. Electroluminescent panel 30 will be described hereinafter with reference to FIG. 3. Lens strip 32 is formed as illustrated, with a plurality of lens elements 78. The lens elements may be made of glass, plastic or other transparent materials and are an integral part of the material forming other portions of the strip. Where a plurality of strips are employed in superimposed registration with one another, each lens element 78 thereof is preferably of the same lens design. Each lens element 78 of each strip is coaxial along the optical path with the lens element of the other strips to form a single imaging device.

Lens strip 32 is formed with lens elements 78 thereon projecting the light image toward the image plane. The strip has its lens elements arranged so that a continuous image of the projected light pattern may be projected. One type of lens strip described is U.S. Pat. No. 3,655,284 issued to Agliata in 1972, the relevant portions thereof being hereby incorporated into the present application. Lens strip 32 functions as a collimator, and lens elements 78 thereon produce an infinitely distant image to project light rays therethrough which are substantially parallel to one another.

Screen 34 is interposed between lens strip 32 and photoconductive surface 12. Thus, the collimated or substantially parallel light rays transmitted from lens strip 32 pass through screen member 34 and are superimposed over the electrostatic latent image recorded on photoconductive surface 12. In this manner, a modulated electrostatic latent image is recorded thereon. Screen 34 may be formed on a translucent layer or substrate which adheres to a transparent portion or substrate. The transparent portion may be made preferably from a suitable transparent plastic or glass material. By way of example, screen 34 may include a plurality of lines or dots printed on a substantially transparent substrate by suitable chemical etching technique, or by a photographic technique. The screen itself may be made from any number of opaque metallic materials suitable for chemical etching such as copper or aluminum. The transparent portion preferably is made from a suitable glass or plastic material. Screen 34, as shown in FIG. 2, has a plurality of equally spaced lines 80 thereon. However, a variety of patterns may be employed in lieu of lines. Examples of screen patterns are rows of dots, or rows of small squares entirely surrounded by black or opaque areas, a checkerboard pattern of transparent and opaque areas, transparent areas continually covered with circular black or opaque dots, or a black or opaque background covered with a random distribution of transparent dots of various sizes. Any one of several screen patterns may be employed. A final screen size generally results in a more natural or higher quality copy. Hence, while a coarse screen having 50 to 60 dots or lines to the linear inch will be useful for some purposes. Fine screens such as those having anywhere from 100 to 400 or more dots or lines per linear inch will give a more nearly continuous tone appearance to the finished copy. With finer screens, the screen pattern may be barely perceptible on the finished copy and the copy will have the appearance of a continuous tone photograph. The contrasting appearance obtained without the use of a screen is eliminated or greatly reduced and large black areas appear to have substantially uniform density throughout.

In lieu of using various screens having different numbers of dots or lines per linear inch, voltage source 76 may be adapted to periodically excite electroluminescent panel 30 at a prescribed frequency to produce a strobing effect. This produces periodic imaging of a dot on the photoconductive surface inasmuch as the photoconductive surface is moving. By adjusting the rate of pulsating electroluminescent panel 30, the dots may be imaged relatively close to each other on the photoconductive surface. As the photoconductive surface rotates, electroluminescent panel 30 is pulsed by power supply 76. Hence, electroluminescent panel 30 is turned on and off at the pulsating rate resulting in a modulated light screen pattern having the requisite dots per linear inch formed on photoconductive surface 12 of drum 10. For example, if screen 34 has a single row of dots and drum 10 rotates at 5 inches per second with electroluminescent panel 30 being turned on and off at the rate of 100 times per second, 20 dots per linear inch will be recorded on photoconductive surface 12.

Figure 3:
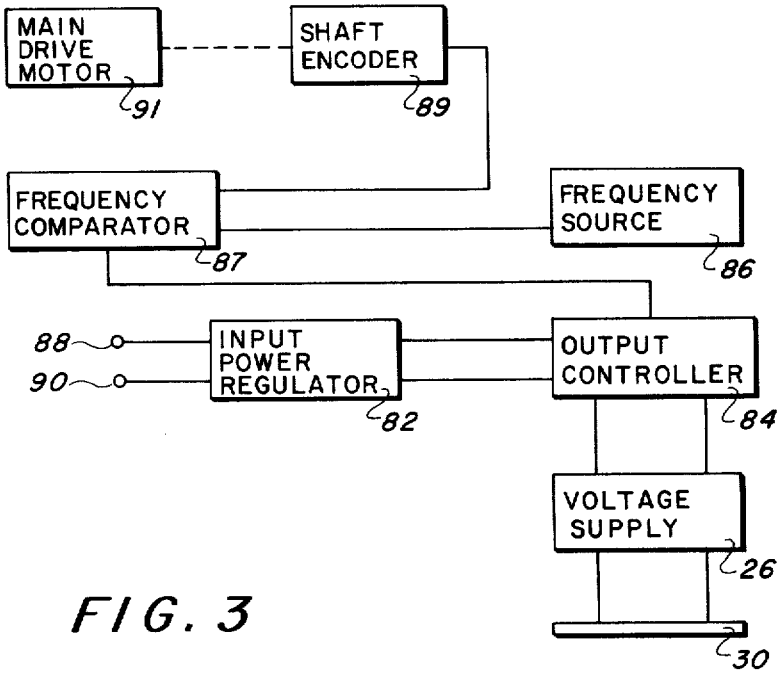
FIG. 3 is a schematic block diagram depicting the circuitry required to energize the light source of the FIG. 2 screening system.

Turning now to FIG. 3, there is shown a suitable electrical circuit adapted to pulsate electroluminescent panel 30 at the prescribed frequency. Input power regulator 84 is excited from line voltage which may range from 98 to 240 volts at terminals 88 and 90. The output from input power regulator 82, which is a regulated voltage, excites output controller 84 at about 24 volts. Output controller 84 energizes voltage supply 76 to excite electroluminescent panel 30. Output controller 84 is, in turn, switched on and off by frequency comparator 87. A main drive motor 91 rotates shaft encoder 89. The output signal from shaft encoder 89 is compared to that of frequency source 86 by frequency comparator 87. This produces the proper timing for pulsing electroluminescent panel 30. Frequency source 86 may be a radio frequency source adapted to provide a reference frequency at the prescribed pulsating rate. In this manner, the desired number of dots per linear inch are recorded on photoconductive surface 12.

In recapitulation, it is evident that the screening apparatus of the present invention superimposes a screened electrostatic latent image on the latent image of the original document so as to form a modulated electrostatic latent image on the photoconductive surface. This latent image will be subsequently developed to produce a copy approximating the characteristics of the original document in the tone and quality. The foregoing is achieved by the employment of an electroluminescent panel generating light rays which are collimated by a lens strip and thereupon pass through screen which irradiates the photoconductive surface in the regions thereof wherein the electrostatic latent image of the original document has been recorded. In this way, a modulated electrostatic latent image is recorded on the photoconductive surface. The foregoing is subsequently developed to produce a half-tone copy corresponding in quality and characteristics to that of the original document being reproduced.

It is, therefore, apparent that there has been provided in accordance with the present invention, an apparatus for producing half-tone copies that fully satisfies the objects, aims and advantages hereinbefore set forth. While the present invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations within the spirit and broad scope of the appended claims.

What is claimed is:

1. An electrophotographic printing machine, including:

a photoconductive member;

means for charging said photoconductive member to a substantially uniform level;

exposure means for forming and projecting a light image of an original document onto the charged portion of said photoconductive member recording thereon an electrostatic latent image;

an electroluminescent panel extending substantially across the width of said photoconductive member;

strip means having lens portions thereon transmitting substantially parallel light rays therethrough from said electroluminescent panel; and a screen member positioned closely adjacent to said photoconductive member in a light receiving relationship with the light rays transmitted through said strip means to illuminate said photoconductive member with a screened light image, the screened light image being superimposed over the electrostatic latent image recording a modulated electrostatic latent image of the original document on said photoconductive member.

2. A printing machine as recited in claim 1, further including means for switching said electroluminescent panel on and off at a preselected frequency to produce pulsed light rays therefrom.

3. A printing machine as recited in claim 2, wherein said exposure means includes:

a light source arranged to illuminate the original document; and lens means, in a light receiving relationship with the light rays transmitted from the original document, for forming a light image thereof arranged to be projected onto said charged photoconductive surface.

4. A printing machine as recited in claim 3, wherein said exposure means includes means for filtering the light image transmitted from said lens means to form a single color light image.

5. A printing machine as recited in claim 4, wherein said screen member includes a plurality of substantially equally spaced lines.

* * * * *